US008813295B1

(12) United States Patent
Washington

(10) Patent No.: US 8,813,295 B1
(45) Date of Patent: Aug. 26, 2014

(54) TICKET SCRATCHING DEVICE

(71) Applicant: Clarence E. Washington, San Leandro, CA (US)

(72) Inventor: Clarence E. Washington, San Leandro, CA (US)

( * ) Notice: Subject to any disclaimer, the term of this patent is extended or adjusted under 35 U.S.C. 154(b) by 0 days.

(21) Appl. No.: 13/875,993

(22) Filed: May 2, 2013

(51) Int. Cl.

| | |
|---|---|
| ***A63F 3/06*** | (2006.01) |
| ***B43L 19/00*** | (2006.01) |
| ***A47L 13/06*** | (2006.01) |
| ***A46B 15/00*** | (2006.01) |
| ***A46B 9/08*** | (2006.01) |

(52) U.S. Cl.
CPC ..... *A63F 3/068* (2013.01)
USPC ..... 15/106; 15/118; 15/160; 15/168; 15/200; 15/229.11

(58) Field of Classification Search
CPC ..... A46B 5/0016; A46B 2200/3093; A46B 9/005; A63F 3/068; A47L 13/04; A47L 13/06; A47L 13/07; A47L 13/12; A47L 13/34; B34L 19/00
USPC ..... 15/106, 118, 160, 168, 169, 184, 200, 15/229.11, 229.13; D4/119; D32/40, 42, D32/51, 52
See application file for complete search history.

(56) References Cited

U.S. PATENT DOCUMENTS

| | | | | |
|---|---|---|---|---|
| 3,099,251 | A | 7/1963 | Hertz | |
| 4,387,480 | A * | 6/1983 | Cobianco | 15/169 |
| 4,794,303 | A | 12/1988 | Hechtel et al. | |
| D357,699 | S | 4/1995 | Takanashi | |
| 5,485,649 | A * | 1/1996 | Miceli | 15/184 |
| 5,544,881 | A | 8/1996 | Rua, Jr. et al. | |
| D389,965 | S * | 1/1998 | Saladino | D32/42 |
| 5,709,491 | A | 1/1998 | Yeh | |
| D401,419 | S * | 11/1998 | Hartmann et al. | D4/135 |
| D401,630 | S | 11/1998 | Pilon et al. | |
| 6,039,486 | A | 3/2000 | Breslin | |
| 6,367,113 | B1 * | 4/2002 | Usui | 15/176.2 |
| 7,465,359 | B2 | 12/2008 | Vives-Martinez | |
| 2012/0324666 | A1 * | 12/2012 | Provenzano | 15/160 |

FOREIGN PATENT DOCUMENTS

| | | | |
|---|---|---|---|
| EP | 300443 | * | 1/1989 |

* cited by examiner

*Primary Examiner* — Mark Spisich

(57) ABSTRACT

A ticket scratching device quickly and easily removes scratch-off material from game tickets to reveal game data concealed underneath the material. The device includes an elongated tubular member having a first end and a second end. Each of the first and second ends is open. A plurality of wires is coupled to the elongated member wherein the wires are configured for removing an opaque scratch-off covering from a game ticket. The wires comprise a first set of wires and a second set of wires. The first set of wires extends outwardly from the first end. The second set of wires extends outwardly from the second end.

17 Claims, 3 Drawing Sheets

TICKET SCRATCHING DEVICE

BACKGROUND OF THE DISCLOSURE

1. Field of the Disclosure

The disclosure relates to scratching devices and more particularly pertains to a new scratching device for quickly and easily removing scratch-off material from game tickets to reveal game data concealed underneath the material.

2. Summary of the Disclosure

An embodiment of the disclosure meets the needs presented above by generally comprising an elongated tubular member having a first end and a second end. Each of the first and second ends is open. A plurality of wires is coupled to the elongated member wherein the wires are configured for removing an opaque scratch-off covering from a game ticket. The wires comprise a first set of wires and a second set of wires. The first set of wires extends outwardly from the first end. The second set of wires extends outwardly from the second end.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
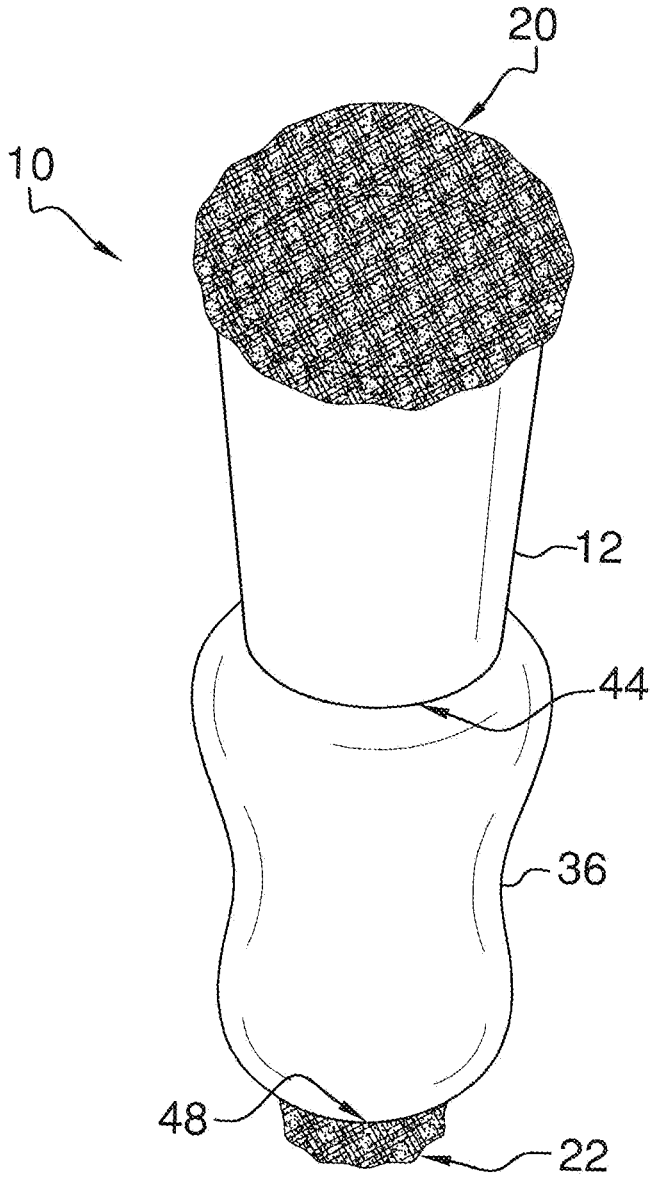
FIG. 1 is a top front side perspective view of a ticket scratching device according to an embodiment of the disclosure.
Figure 2:
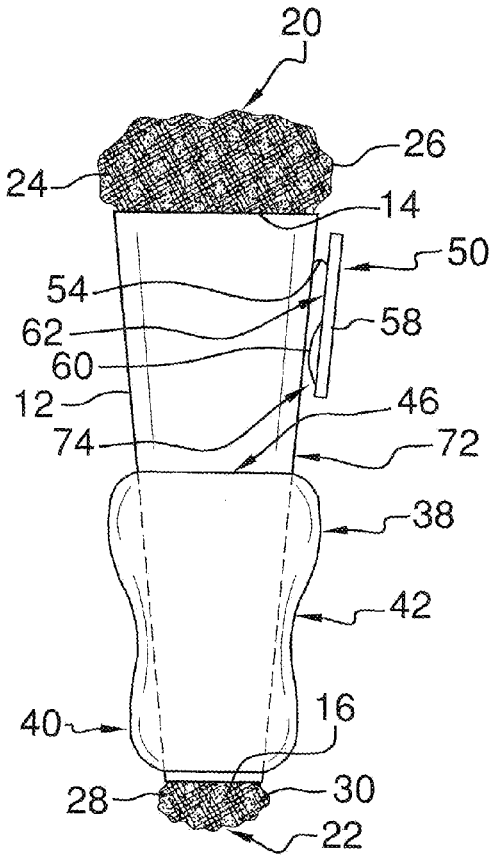
FIG. 2 is a side view of an embodiment of the disclosure.
Figure 3:
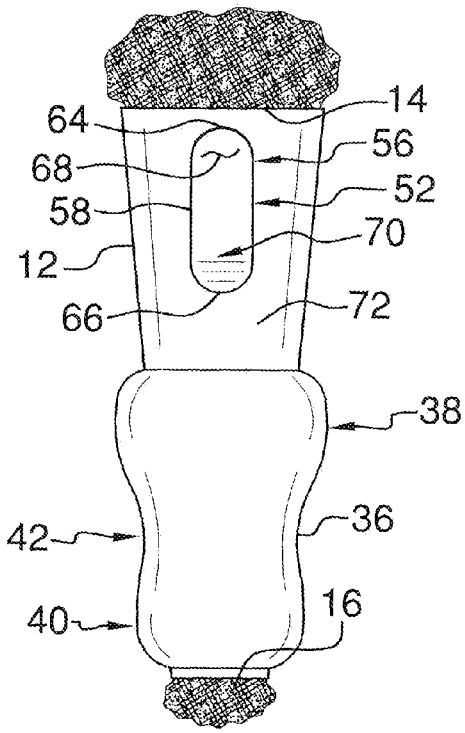
FIG. 3 is a back view of an embodiment of the disclosure.
Figure 4:
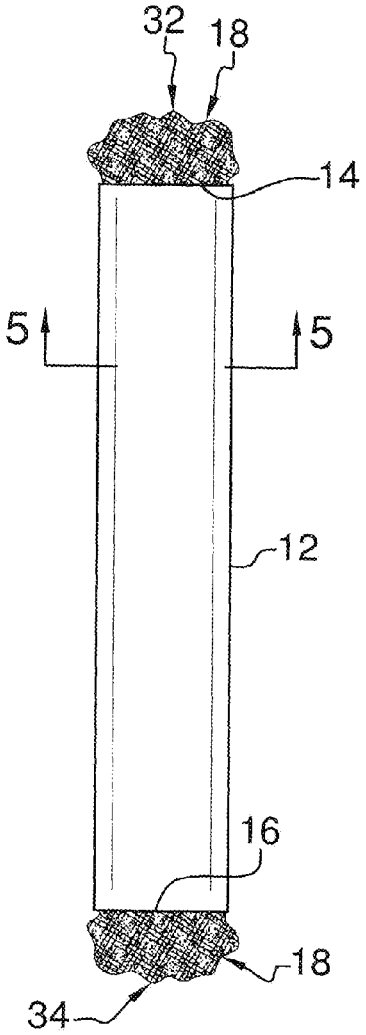
FIG. 4 is a front view of an alternate embodiment of the disclosure.
Figure 5:
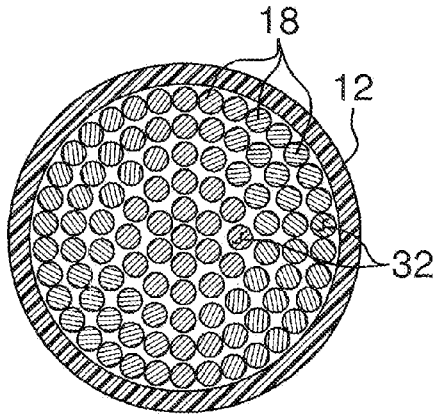
FIG. 5 is a cross-sectional view of an embodiment of the disclosure taken along line 5-5 of FIG. 4.

With reference now to the drawings, and in particular to FIGS. 1 through 5 thereof, a new scratching device embodying the principles and concepts of an embodiment of the disclosure and generally designated by the reference numeral 10 will be described.

As best illustrated in FIGS. 1 through 5, the ticket scratching device 10 generally comprises an elongated tubular member 12 having a first end 14 and a second end 16. Each of the first 14 and second 16 ends is open. The tubular member 12 may taper from the first end 14 downwardly to the second end 16. The tubular member 12 may be comprised from plastic, metal, or like material, such as polyvinyl chloride.

A plurality of wires 18 is coupled to the tubular member 12 wherein the wires 18 are configured for removing an opaque scratch-off covering from a game ticket. More specifically, the wires are designed to quickly and easily scratch off the latex paint from lottery tickets. The wires 18 may comprise a first set of wires 20 and a second set of wires 22. The first set of wires 20 extends outwardly from the first end 14. The second set of wires 22 extends outwardly from the second end 16. The first set of wires 20 may extend outwardly from the first end 14 a greater length than the second set of wires 22 extends outwardly from the second end 16. A distance from a first side 24 to a second side 26 of the first set of wires 20 may be greater than a distance from a first side 28 to a second side 30 of the second set of wires 22.

Alternatively, the first end 14 of the tubular member 12 may have a circumference equal to the second end 16 of the tubular member 12. In the alternative embodiment, a plurality of wires 18 extends through the tubular member 12 such that the wires 18 extend from the first end 14 to the second end 16. Each of the wires 18 has a top end 32 extending outwardly from the first end 14 of the tubular member 12 and a bottom end 34 extending outwardly from the second end 16 of the tubular member 12. The top end 32 of the wires 18 may be spaced from the first end 14 of the tubular member 12 a same distance as the bottom end 34 of the wires 18 are spaced from the second end 16 of the tubular member 12.

A grip 36 is preferably coupled to the tubular member 12. The grip 36 may extend a full length around a circumference of the tubular member 12. The grip 36 has an upper portion 38, a lower portion 40, and a medial portion 42 extending between the upper 38 and lower 40 portions. Each of the upper 38 and lower 40 portions may be convexly arcuate, while the medial portion 42 may be concavely arcuate. A top edge 44 of the upper portion 38 is preferably coupled to a midpoint 46 between the first end 14 and the second end 16. A bottom edge 48 of the lower portion 40 is preferably positioned proximate the second end 16. The grip 36 may be comprised of a resiliently compressible material, such as rubber or like material.

A fastener 50 is coupled to the tubular member 12 and preferably comprises a clip 52. The clip 52 has a coupling member 54 and a retaining member 56. The retaining member 56 comprises a main portion 58 and a projection 60. The projection 60 extends outwardly from a back side 62 of the main portion 58. The projection 60 may be convexly arcuate. The main portion 58 is elongated and has a top end 64 spaced from a bottom end 66. Each of the top 64 and bottom 66 ends is preferably arcuate. The top end 64 is positioned proximate the first end 14 of the tubular member 12. The main portion 58 has a front side 68 with a plurality of ridges 70 coupled thereto. The ridges 70 may be positioned proximate the bottom end 66. The coupling member 54 couples the back side 62 of the main portion 58 to a back side 72 of the tubular member 12. The coupling member 54 is preferably arcuate. The retaining member 56 is spaced from the tubular member 12 wherein the retaining member 56 is configured for coupling the tubular member 12 to a shirt of a user when the shirt is positioned within a receiving space 74 between the retaining member 56 and the tubular member 12 such that the projection 60 abuts and secures the shirt within the receiving space 74.

The full length of the device 10 is between approximately 5.0 centimeters and 25.0 centimeters. The length of the grip 36 is between approximately 1.0 centimeter and 10.0 centimeters. The first set of wires 20 extends outwardly from the first end 14 a length between approximately 1.0 centimeters and 5.0 centimeters. The second set of wires 22 extends outwardly from the second end 16 a length between approximately 0.10 centimeters and 3.0 centimeters. The length between the bottom edge 48 of the lower portion 40 of the grip 36 and the first end 14 of the tubular member 12 is between approximately 3.0 centimeters and 20.0 centimeters.

In use, as stated above and shown in the Figures, the wires 18 are scratched against the opaque covering on lottery tickets until the game data below the covering is exposed. If desired, the grip 36 is grasped to provide comfort to a hand of a user while the user scratches the wires 18 against the lottery tickets. The fastener 50 is used to attach the device 10 to the shirt of a user in order to retain the device 10 on the user's shirt while the device 10 is not in use.

With respect to the above description then, it is to be realized that the optimum dimensional relationships for the pans of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ticket scratching device comprising:

an elongated tubular member, said tubular member having a first end and a second end, each of said first and second ends being open, said tubular member tapering from said first end downwardly to said second end; and a plurality of wires coupled to said elongated member wherein said wires are configured for removing an opaque scratch-off covering from a game ticket, said wires comprising a first set of wires and a second set of wires, said first set of wires extending outwardly from said first end, said second set of wires extending outwardly from said second end, a distance from a first side to a second side of said first set of wires being greater than a distance from a first side to a second side of said second set of wires.

2. The device of claim 1, further comprising said first set of wires extending outwardly from said first end a greater length than said second set of wires extend outwardly from said second end.

3. The device of claim 1, further comprising a grip coupled to said tubular member.

4. The device of claim 3, further comprising said grip extending a full length around a circumference of said tubular member.

5. The device of claim 3, further comprising said grip being comprised of a resiliently compressible material.

6. The device of claim 3, further comprising said grip having an upper portion, a lower portion, and a medial portion extending between said upper and lower portions, each of said upper and lower portions being convexly arcuate, said medial portion being concavely arcuate.

7. The device of claim 6, further comprising a top edge of said upper portion being coupled to a midpoint between said first end and said second end.

8. The device of claim 6, further comprising a bottom edge of said lower portion being positioned proximate said second end.

9. The device of claim 1, further comprising a fastener coupled to said tubular member wherein said fastener comprises a clip.

10. The device of claim 9, further comprising said clip having a coupling member and a retaining member, said retaining member comprising a main portion and a projection, said projection extending outwardly from a back side of said main portion.

11. The device of claim 10, further comprising said projection being convexly arcuate.

12. The device of claim 10, further comprising said main portion being elongated and having a top end spaced from a bottom end, each of said top and bottom ends being arcuate.

13. The device of claim 12, further comprising said top end being positioned proximate said first end of said tubular member.

14. The device of claim 12, further comprising said main portion having a front side with a plurality of ridges coupled thereto, said ridges being positioned proximate said bottom end.

15. The device of claim 10, further comprising said coupling member coupling said back side of said main portion to a back side of said tubular member, said coupling member being arcuate.

16. The device of claim 10, further comprising said retaining member being spaced from said tubular member wherein said retaining member is configured for coupling said tubular member to a shirt of a user when the shirt is positioned within a receiving space between said retaining member and said tubular member such that said projection abuts and secures the shirt within said receiving space.

17. A ticket scratching device comprising:

an elongated tubular member, said tubular member having a first end and a second end, each of said first and second ends being open, said tubular member tapering from said first end downwardly to said second end;

a plurality of wires coupled to said tubular member wherein said wires are configured for removing an opaque scratch-off covering from a game ticket, said wires comprising a first set of wires and a second set of wires, said first set of wires extending outwardly from said first end, said second set of wires extending outwardly from said second end, said first set of wires extending outwardly from said first end a greater length than said second set of wires extend outwardly from said second end, a distance from a first side to a second side of said first set of wires being greater than a distance from a first side to a second side of said second set of wires;

a grip coupled to said tubular member, said grip extending a full length around a circumference of said tubular member, said grip having an upper portion, a lower portion, and a medial portion extending between said upper and lower portions, each of said upper and lower portions being convexly arcuate, said medial portion being concavely arcuate, a top edge of said upper portion being coupled to a midpoint between said first end and said second end, a bottom edge of said lower portion being positioned proximate said second end, said grip being comprised of a resiliently compressible material; and a fastener coupled to said tubular member wherein said fastener comprises a clip, said clip having a coupling member and a retaining member, said retaining member comprising a main portion and a projection, said projection extending outwardly from a back side of said main portion, said projection being convexly arcuate, said main portion being elongated and having a top end spaced from a bottom end, each of said top and bottom ends being arcuate, said top end being positioned proximate said first end of said tubular member, said main portion having a front side with a plurality of ridges coupled thereto, said ridges being positioned proximate said bottom end, said coupling member coupling said back side of said main portion to a back side of said tubular member, said coupling member being arcuate, said retaining member being spaced from said tubular member wherein said retaining member is configured for coupling said tubular member to a shirt of a user when the shirt is positioned within a receiving space between said retaining member and said tubular member such that said projection abuts and secures the shirt within said receiving space.

* * * * *